US009439258B2

(12) United States Patent
Kim et al.

(10) Patent No.: US 9,439,258 B2
(45) Date of Patent: Sep. 6, 2016

(54) CONTROL CIRCUIT OF LED LIGHTING APPARATUS

(71) Applicant: SILICON WORKS CO., LTD., Daejeon-si (KR)

(72) Inventors: Yong Geun Kim, Suwon-si (KR); Ki Chul An, Daegu-si (KR); Sang Young Lee, Jeonju-si (KR)

(73) Assignee: SILICON WORKS CO., LTD., Daejeon-Si (KR)

( * ) Notice: Subject to any disclaimer, the term of this patent is extended or adjusted under 35 U.S.C. 154(b) by 0 days.

(21) Appl. No.: 14/770,186

(22) PCT Filed: Feb. 27, 2014

(86) PCT No.: PCT/KR2014/001651

§ 371 (c)(1),
(2) Date: Aug. 25, 2015

(87) PCT Pub. No.: WO2014/133349

PCT Pub. Date: Sep. 4, 2014

(65) Prior Publication Data

US 2016/0014862 A1 Jan. 14, 2016

(30) Foreign Application Priority Data

Feb. 28, 2013 (KR) ..... 10-2013-0021909

(51) Int. Cl.
*H05B 33/08* (2006.01)

(52) U.S. Cl.
CPC ..... *H05B 33/0845* (2013.01); *H05B 33/083* (2013.01); *H05B 33/0809* (2013.01); *H05B 33/0815* (2013.01); *H05B 33/0824* (2013.01)

(58) Field of Classification Search
CPC .. H05B 37/02; H05B 33/08; H05B 33/0809; H05B 33/0824; H05B 33/083; H05B 33/0815; H05B 33/084
USPC ..... 315/121, 185 R, 192, 201, 291, 294, 315/308, 312
See application file for complete search history.

(56) References Cited

U.S. PATENT DOCUMENTS

2011/0227489 A1* 9/2011 Huynh ..... H05B 33/083 315/185 R
2014/0049174 A1* 2/2014 Radermacher ..... H05B 33/0821 315/200 R
2016/0095179 A1* 3/2016 Jang ..... H05B 33/083 315/125

FOREIGN PATENT DOCUMENTS

KR 10-1083782 11/2011
KR 10-2012-0043188 5/2012

(Continued)

OTHER PUBLICATIONS

Written Opinion with English translation for International Application No. PCT/KR2014/001651, dated Jun. 23, 2014.

(Continued)

*Primary Examiner* — Thai Pham
(74) *Attorney, Agent, or Firm* — Kile Park Reed & Houtteman PLLC

(57) ABSTRACT

Provided is a control circuit of an LED lighting apparatus, which is capable of reducing the occurrence of a flicker while performing lighting. The control circuit of the LED lighting apparatus may include a charge and discharge module charged by a rectified voltage and discharging LED channels, and control one or more of charge timing, a charged voltage, and discharge timing of the charge and discharge module such that the charge and discharge module supplies a voltage to the LED channels at least during a control period at which the amount of current supplied to the LED channels is the smallest. Thus, the occurrence of a flicker in the LED lighting apparatus can be improved.

21 Claims, 13 Drawing Sheets

(56) References Cited

FOREIGN PATENT DOCUMENTS

| | | |
|---|---|---|
| KR | 10-1175934 | 8/2012 |
| KR | 10-1211094 | 12/2012 |
| KR | 10-2013-0015609 | 2/2013 |

OTHER PUBLICATIONS

International Search Report with English translation for International Application No. PCT/KR2014/001651, dated Jun. 23, 2014.

* cited by examiner

CONTROL CIRCUIT OF LED LIGHTING APPARATUS

BACKGROUND

1. Technical Field

The present disclosure relates to an LED lighting apparatus, and more particularly, to a control circuit of an LED lighting apparatus, which is capable of reducing a flicker while performing lighting using a rectified voltage.

2. Related Art

According to the recent trend of lighting technology, LEDs have been employed as a light source in order to reduce energy.

A high-brightness LED is differentiated from other light sources in terms of various aspects such as energy consumption, lifetime, and light quality.

However, a lighting apparatus using LEDs as a light source may require additional circuits due to the characteristic of the LEDs which are driven by a constant current.

Examples of lighting apparatuses which have been developed to solve the above-described problem may include an AC direct-type lighting apparatus.

In general, the AC direct-type LED lighting apparatus is designed to rectify a commercial voltage and drive an LED using the rectified voltage which has a ripple twice larger than the commercial frequency.

Since the above-described AC direct-type LED lighting apparatus directly uses the rectified voltage as an input voltage without using an inductor and capacitor, the AC direct-type LED lighting apparatus has a satisfactory power factor.

Each LED of the LED lighting apparatus may be designed to be operated at 2.8V or 3.8V, for example. Furthermore, the LED lighting apparatus may be designed to be operated by a rectified voltage having a level at which a large number of LEDs connected in series can emit light.

As the ripple of the rectified voltage increases/decreases, a large number of LEDs included in the LED lighting apparatus may be sequentially turned on/off at each LED channel.

Since the rectified voltage which is supplied to drive the LED lighting apparatus has a ripple, the rectified voltage has a section in which it falls to such a level that the LED channels cannot emit light.

That is, the rectified voltage of the LED lighting apparatus substantially falls below the light emitting voltage of the LEDs due to the ripple. Thus, the current supplied to each LED channel has a section in which it falls below the lowest current and then rises.

When the entire LED channels are temporarily turned off, a flicker may occur. The flicker may degrade a feeling of use or increase the fatigue degree of a user.

Japan has defined a standard for the flicker levels of LED lighting apparatuses using a rectified voltage, based on the PSE standard. For example, the PSE standard of Japan has suggested a flicker level at which light output is sustained at 5% or more based on 100%, when a rectified voltage having a frequency of 100 Hz to 500 Hz is used to drive an LED.

Therefore, the LED lighting apparatus which is driven according to the rectified voltage characteristic needs to be designed to improve the flicker level.

SUMMARY

Various embodiments are directed to a control circuit of an LED lighting apparatus, which is capable of reducing the occurrence of a flicker.

Also, various embodiments are directed to a control circuit of an LED lighting apparatus, which is capable of reducing the occurrence of a flicker by controlling one or more of charge timing, a charged voltage, and discharge timing.

Also, various embodiments are directed to a control circuit of an LED lighting apparatus, which is capable of discharging a voltage at a period in which a flicker occurs, such that LED channels maintain the minimum light emission state, thereby reducing the occurrence of a flicker.

Also, various embodiments are directed to a control of an LED lighting apparatus, which is capable of performing a charging operation using a voltage having a lower level than the maximum value (peak voltage) of a rectified voltage, and discharging the voltage at a period in which a flicker occurs, thereby reducing the occurrence of the flicker.

In an embodiment, a control circuit of an LED lighting apparatus divided into a plurality of LED channels may include: a current control circuit configured to provide a current path corresponding to sequential emissions of the LED channels in response to a rectified voltage; and a flicker reduction circuit including a charge and discharge module charged by the rectified voltage and discharging the LED channels, and configured to control one or more of charge timing, a charged voltage, and discharge timing of the charge and discharge module such that the charge and discharge module supplies a voltage to the LED channels at least during a control period at which the amount of current supplied to the LED channels is the smallest.

In accordance with the embodiments of the present invention, the control circuit may control one or more of the charge timing, the charged voltage, and the discharge timing and reduce the occurrence of a flicker, thereby improving the reliability of the LED lighting apparatus driven by the rectified voltage.

Furthermore, a capacitor with a small capacity may be used to sufficiently reduce a flicker caused by voltage charge and discharge. Thus, although capacitors are applied, the reduction of lifetime or power factor can be minimized, and the occurrence of flicker can also be reduced.

Furthermore, the LED lighting apparatus may perform lighting while maintaining the minimum light emission state, thereby reducing the occurrence of a flicker.

Furthermore, since the charging operation is performed at a lower level than the peak value (maximum value) of the rectified voltage, power consumption can be improved.

DETAILED DESCRIPTION

Figure 1:
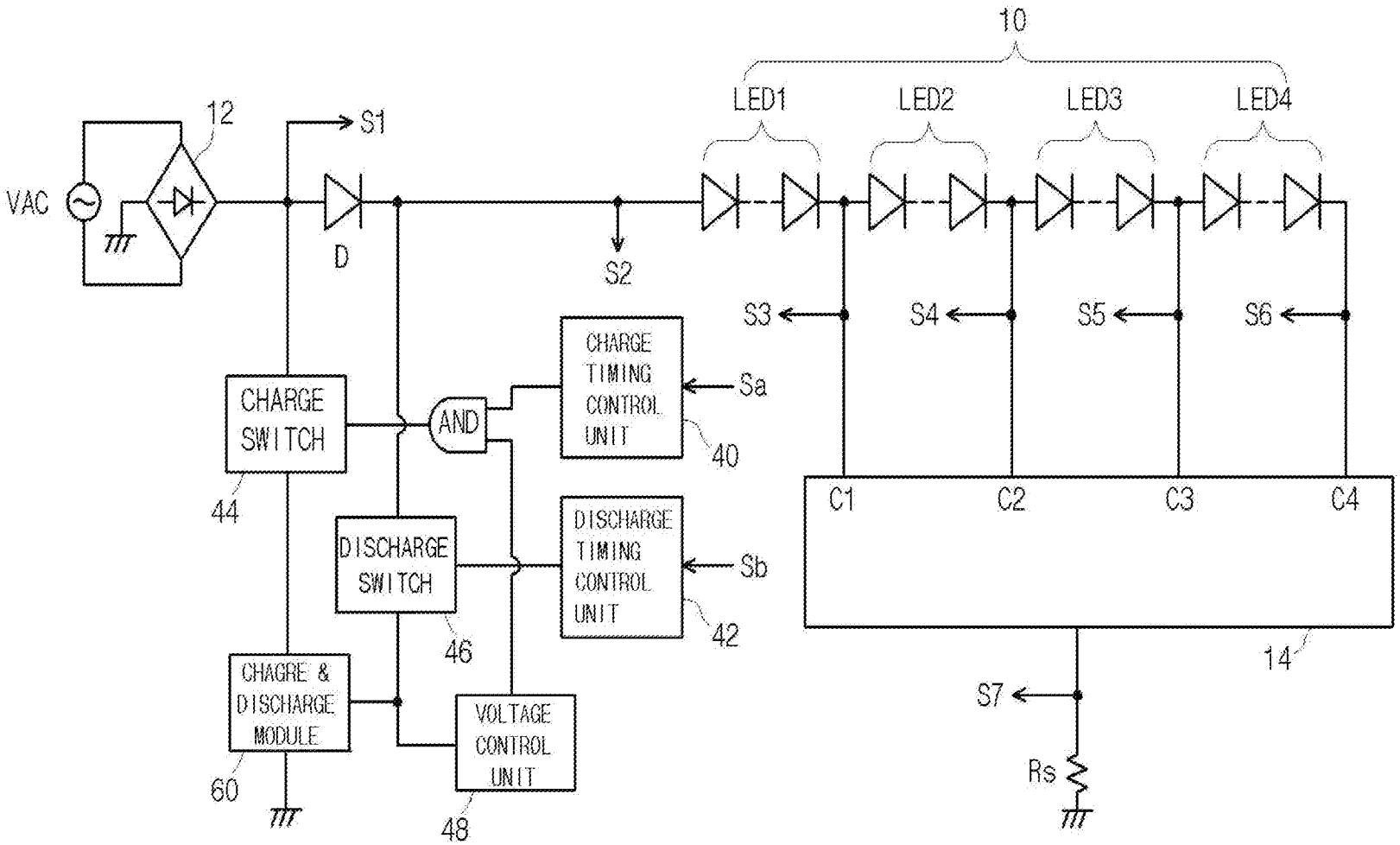
FIG. 1 is a circuit diagram illustrating a control circuit of an LED lighting apparatus in accordance with an embodiment of the present invention.

Exemplary embodiments will be described below in more detail with reference to the accompanying drawings. The disclosure may, however, be embodied in different forms and should not be constructed as limited to the embodiments set forth herein. Rather, these embodiments are provided so that this disclosure will be thorough and complete, and will fully convey the scope of the disclosure to those skilled in the art. Throughout the disclosure, like reference numerals refer to like parts throughout the various figures and embodiments of the disclosure.

The embodiments of the present invention disclose a control circuit of an AC direct-type LED lighting apparatus.

A rectified voltage for the AC direct-type LED lighting apparatus may have a ripple obtained by full-wave rectifying an AC voltage, and indicate a voltage having a characteristic in which a ripple repetitively rises/falls as illustrated in FIGS. 3 to 7 and 12.

The control circuit of the LED lighting apparatus in accordance with the embodiment of the present invention may be configured to perform current regulation for light emission of a lamp 10 as illustrated in FIG. 1.

Referring to FIG. 1, the LED lighting apparatus may include a lamp 10, a power supply unit, a current control circuit 14, and a flicker reduction circuit. The power supply unit may provide a rectified voltage obtained by converting an AC voltage to the lamp 10, and the current control circuit 14 may provide a current path for light emission to each of LED channels LED1 to LED4 of the lamp 10.

The lamp 10 may include a plurality of LEDs which are divided into the plurality of LED channels LED1 to LED4. The LEDs of the lamp 10 may be sequentially turned on/off at each LED channel according to the ripple of the rectified voltage provided from the power supply unit.

FIG. 1 illustrates that the lamp 10 includes four LED channels LED1 to LED4. Each of the LED channels LED1 to LED4 may include an equal or different number of LEDs, and a dotted line in each of the LED channels LED1 to LED4 indicates that illustration of the LEDs is omitted.

The power supply unit may be configured to rectify an AC voltage introduced from outside and output the rectified voltage.

The power supply unit may include an AC power source VAC having an AC voltage and a rectifier circuit 12 configured to output a rectified voltage by rectifying the AC voltage. The AC power source VAC may include a commercial power source.

The rectifier circuit 12 may full-wave rectify a sine-wave AC voltage of the AC power source VAC, and output the rectified voltage. As illustrated in FIGS. 3 to 7 and 12, the rectified voltage may have a ripple in which the voltage level thereof rises and falls on the basis of a half cycle of the AC voltage. In the embodiment of the present invention, the rise or fall of the rectified voltage may indicate a rise or fall of the ripple of the rectified voltage.

The current control circuit 14 may perform current regulation for light emission of the LED channels LED1 to LED4.

The current control circuit 14 may be configured to provide a current path for current regulation through a current sensing resistor Rs of which one end is grounded.

In the embodiment of the present invention, the LED channels LED1 to LED4 of the lamp 10 may be sequentially turned on or off in response to a rise or fall of the rectified voltage.

When the rectified voltage rises to sequentially reach the light emitting voltages of the respective LED channels LED1 to LED4, the current control circuit 14 may provide a current path for light emission to the respective LED channels LED1 to LED4. In the current control circuit 14, C1, C2, C3, and C4 represent terminals for providing a current path to the respective LED channels LED1 to LED4.

At this time, a light emitting voltage V4 which causes the LED channel LED4 to emit light may be defined as the voltage at which all of the LED channels LED1, LED2, LED3, and LED4 can emit light, a light emitting voltage V3 which causes the LED channel LED3 to emit light may be defined as the voltage at which the LED channels LED1, LED2, and LED3 can emit light, a light emitting voltage V2 which causes the LED channel LED2 to emit light may be defined as the voltage at which the LED channels LED1 and LED2 can emit light, and a light emitting voltage V1 which causes the LED channel LED1 to emit light may be defined as the voltage at which only the LED channel LED1 can emit light.

The current control circuit 14 may receive a current sensing voltage through the current sensing resistor Rs. The current sensing voltage may be varied by a current path which is differently formed depending on the light emission state of each LED channel in the lamp 10. At this time, the current flowing through the current sensing resistor Rg may include a constant current.

Figure 2:
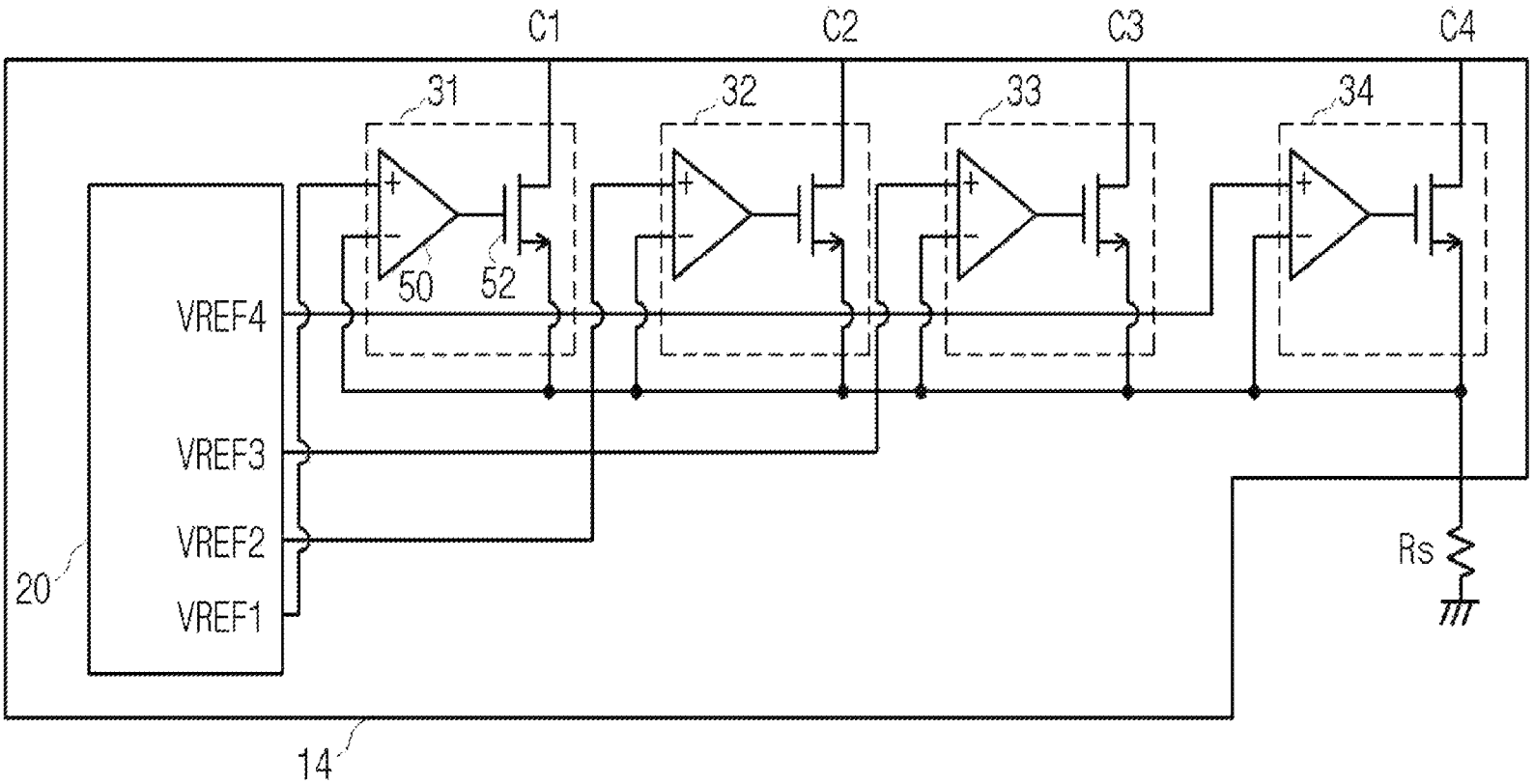
FIG. 2 is a detailed circuit diagram of a current control circuit of FIG. 1.

The current control circuit 14 may be configured as illustrated in FIG. 2. Referring to FIG. 2, the current control circuit 14 may include a plurality of switching circuits 31 to 34 configured to provide a current path to the respective LED channels LED1 to LED4 and a reference voltage supply unit 20 configured to provide reference voltages VREF1 to VREF4.

The reference voltage supply unit 20 may be configured to provide the reference voltages VREF1 to VREF4 having different levels according to a designer's intention.

The reference voltage supply unit 20 may include a plurality of resistors which are connected in series so as to receive a constant voltage, for example, and output the reference voltages VREF1 to VREF4 having different levels through the respective nodes among the resistors. In another embodiment, the reference voltage supply unit 20 may include independent voltage supply sources for providing the reference voltages VREF1 to VREF4 having different levels.

Among the reference voltages VREF1 to VREF4 having different levels, the reference voltage VREF1 may have the lowest voltage level, and the reference voltage VREF4 may have the highest voltage level. The voltage level may gradually increase in order of the reference voltages VREF1, VREF2, VREF3, and VREF4.

The reference voltage VREF1 may have a level for turning off the switching circuit 31 at the time point where the LED channel LED2 emits light. More specifically, the reference voltage VREF1 may be set to a lower level than a current sensing voltage which is formed in the current sensing resistor Rs by the light emitting voltage V2 of the LED channel LED2.

The reference voltage VREF2 may have a level for turning off the switching circuit 32 at the time point where the LED channel LED3 emits light. More specifically, the reference voltage VREF2 may be set to a lower level than a current sensing voltage which is formed in the current sensing resistor Rs by the light emitting voltage V3 of the LED channel LED3.

The reference voltage VREF3 may have a level for turning off the switching circuit 33 at the time point where the LED channel LED4 emits light. More specifically, the reference voltage VREF3 may be set to a lower level than a current sensing voltage which is formed in the current sensing resistor Rs by the light emitting voltage V4 of the LED channel LED4.

The reference voltage VREF4 may be set in such a manner that the current formed in the current sensing resistor Rs becomes a constant current in the upper limit level region of the rectified voltage.

The switching circuits 31 to 34 may be commonly connected to the current sensing resistor Rs which provides a current sensing voltage in order to perform current regulation and form a current path.

The switching circuits 31 to 34 may compare the current sensing voltage of the current sensing resistor Rs to the reference voltages VREF1 to VREF4 of the reference voltage supply unit 20, and form a selective current path for turning on the lamp 10.

Each of the switching circuits 31 to 34 may receive a high-level reference voltage as the switching circuit is connected to an LED channel remote from the position to which the rectified voltage is applied.

Each of the switching circuits 31 to 34 may include a comparator 50 and a switching element, and the switching element may include an NMOS transistor 52.

The comparator 50 included in each of the switching circuits 31 to 34 may have a positive input terminal (+) configured to receive a reference voltage, a negative input terminal (−) configured to receive a current sensing voltage, and an output terminal configured to output a result obtained by comparing the reference voltage and the current sensing voltage.

The NMOS transistor 52 included in each of the switching circuits 31 to 34 may perform a switching operation according to the output of the comparator 50, which is applied to the gate thereof.

In an embodiment, a voltage control unit 48 may not be included, but a charge timing control unit 40 may directly control a charge switch 44.

In this case, the flicker reduction circuit may be charged with a rectified voltage during a predetermined charge period, and discharge the LED channels LED1 to LED4 during a control period at which the amount of current supplied to the LED channels LED1 to LED4 is smallest.

The flicker reduction circuit may include a charge and discharge module 60 configured to be charged with a rectified voltage and discharge the LED channels LED1 to LED4. The flicker reduction circuit may control one or more of charge timing and discharge timing of the charge and discharge module 60, and control the discharge and discharge module 60 to provide a voltage to the LED channels. The flicker reduction circuit may include the charge and discharge module 60, a charge control circuit, and a discharge control circuit. The charge and discharge module 60 may perform charging and discharging. The charge control circuit may provide a rectified voltage to the charge and discharge module 60 during the charge period. The discharge control circuit may provide the voltage of the charge and discharge module 60 to the plurality of LED channels LED1 to LED4 during the control period.

The charge and discharge module 60 may include a capacitor C or valley-fill circuit. The charge and discharge module 60 may include a constant voltage source, and the detailed configuration thereof will be described below with reference to FIGS. 10 and 11.

The charge control circuit may include a charge switch 44 and a charge timing control unit 40. The charge switch 44 may switch switching the rectified voltage to the charge and discharge module 60. The charge timing control unit 40 may turn on the charge switch 44 during a charge period.

When the charge timing control unit 40 is configured to directly control the charge switch 44, the charge switch 44 may be turned on in response to the charge period. The charge and discharge module 60 may be charged with a rectified voltage supplied through the turned-on charge switch 44.

The discharge control circuit may include a discharge switch 46 and a discharge timing control unit 42. The discharge switch 46 may switch supplying the voltage of the charge and discharge module 60 to the plurality of LED modules LED1 to LED4, and the discharge timing control unit 42 may turn on the discharge switch 46 during a control period.

Through the above-described configuration, the discharge timing control unit 42 may turn on the discharge switch 46 in response to the control period, and the voltage of the charge and discharge module 60 may be provided to the plurality of LED channels LED1 to LED4 through the turned-on discharge switch 46.

FIG. 1 illustrates that the discharge switch 46 is connected to the input terminal of the LED channel LED1, in order to implement the embodiment of the present invention. However, according to a designer's intention, the discharge switch 46 may be connected to the input terminals of the other LED channels LED2 to LED4. In this case, the voltage of the charge and discharge module 60 may be supplied through the position to which the discharge switch 46 is connected.

In the embodiment of the present invention, however, the charge switch 44 may be controlled according to a result obtained by combining a turn-on signal of the charge timing control unit 40 and a voltage control signal of the voltage control unit 48 through an AND gate, as illustrated in FIG. 1.

The voltage control unit 48 may be configured to output a voltage control signal indicating a charging unsuitable state including one or more of a first state, a second state, and a third state. The first state may indicate that the voltage stored in the charge and discharge module 60 is equal to or more than a predetermined charge level, the second state may indicate that the voltage stored in the charge and discharge module 60 is equal to or more than a rectified voltage, and the third state may indicate that the rectified voltage is equal to or less than a predetermined level. The voltage control signal outputted from the voltage control unit 48 may be provided to the AND gate AND, and the AND gate AND may combine the voltage control signal and the turn-on signal of the charge timing control unit 40 and control the switching operation of the charge switch 44.

When the voltage control unit 48 provides the voltage control signal to the AND gate, the voltage control signal indicating that the current state does not correspond to the charging unsuitable state, the flicker reduction circuit may perform an operation corresponding to the case in which the charge switch 44 is directly controlled by the charge timing control unit 40.

When the voltage control unit 48 provides the voltage control signal to the AND gate, the voltage control signal indicating that the current state corresponds to the charging unsuitable state, the flicker reduction circuit may control a turn-on of the charge switch 44 according to a result of an AND operation on the turn-on signal of the charge timing control unit 40 and the voltage control signal.

In response to the configuration of the voltage control unit 48, the flicker reduction circuit may include a charge control circuit and a discharge control circuit. The charge control circuit may provide a rectified voltage to the charge and discharge module 60 during a charge period which does not correspond to the charging unsuitable state, and the discharge control circuit may provide the voltage of the charge and discharge module 60 to the plurality of LED channels LED1 to LED4 during a control period.

The charge control circuit may include the charge switch 44, the charge timing control unit 40, and a switch control circuit. The charge switch 44 may switch supplying a rectified voltage to a capacitor C serving as a voltage source. The charge timing control unit 40 may provide a turn-on signal for turning on the charge switch 44 during a charge period. The switching control circuit may turn on the charge switch 44 according to the voltage control signal and the turn-on signal, during a time which does not correspond to the charging unsuitable state but satisfies the charge period.

The switching control circuit may include the above-described AND gate AND.

When the voltage of the charge and discharge module 60 is equal to or more than a predetermined charge level as defined as the first state of the charging unsuitable state, it may correspond to a state in which charging is not necessary, because the charge and discharge module 60 is sufficiently charged. Furthermore, when the voltage of the charge and discharge module 60 is equal to or more than a rectified voltage as defined as the second state of the charging unsuitable state, it may correspond to a state in which the charge and discharge module 60 is difficult to charge, because the level of the rectified voltage is low. Furthermore, when the rectified voltage is equal to or more than a predetermined level as defined as the third state of the charging unsuitable state, it may also correspond to a state in which the charge and discharge module 60 is difficult to charge, because the level of the rectified voltage is low.

First, referring to FIG. 3, the operation of a control circuit of a general LED lighting apparatus will be described as follows.

First, when a rectified voltage is in the initial state, the LED channels may not emit light. Thus, the current sensing resistor Rs may provide a low-level current sensing voltage.

When the rectified voltage is in the initial state, all of the switching circuits 31 to 34 may maintain a turn-on state, because the reference voltages VREF1 to VREF4 applied to the positive input terminals (+) of the respective switching circuits 31 to 34 are higher than the current sensing voltage applied to the negative input terminals (−).

Then, when the rectified voltage rises to reach the light emitting voltage V1, the LED channel LED1 of the lamp 10 may emit light. When the LED channel LED1 of the lamp 10 emits light, the switching circuit 31 of the current control circuit 14, connected to the LED channel LED1, may provide a current path.

When the rectified voltage reaches the light emitting voltage V1 such that the LED channel LED1 emits light and a current path is formed through the switching circuit 31, the level of the current sensing voltage of the current sensing resistor Rs may rise. At this time, however, since the level of the current sensing voltage is low, the turn-on states of the switching circuits 31 to 34 may not be changed.

Then, when the rectified voltage continuously rises to reach the light emitting voltage V2, the LED channel LED2 of the lamp 10 may emit light. When the LED channel LED2 of the lamp 10 emits light, the switching circuit 32 of the current control circuit 14, connected to the LED channel LED2, may provide a current path. At this time, the LED channel LED1 may also maintain the light emission state.

When the rectified voltage reaches the light emitting voltage V2 such that the LED channel LED2 emits light and the current path is formed through the switching circuit 32, the level of the current sensing voltage of the current sensing resistor Rs may rise. At this time, the current sensing voltage may have a higher level than the reference voltage VREF1. Therefore, the NMOS transistor 52 of the switching circuit 31 may be turned off by an output of the comparator 50. That is, the switching circuit 31 may be turned off, and the switching circuit 32 may provide a selective current path corresponding to the light emission of the LED channel LED2.

Then, when the rectified voltage continuously rises to reach the light emitting voltage V3, the LED channel LED3 of the lamp 10 may emit light. When the LED channel LED3 of the lamp 10 emits light, the switching circuit 33 of the current control circuit 14, connected to the LED channel LED3, may provide a current path. At this time, the LED channels LED1 and LED2 may also maintain the light emission state.

When the rectified voltage reaches the light emitting voltage V3 such that the LED channel LED3 emits light and the current path is formed through the switching circuit 33, the level of the current sensing voltage of the current sensing resistor Rs may rise. At this time, the current sensing voltage may have a higher level than the reference voltage VREF2. Therefore, the NMOS transistor 52 of the switching circuit 32 may be turned off by the output of the comparator 50. That is, the switching circuit 32 may be turned off, and the switching circuit 33 may provide a selective current path corresponding to the light emission of the LED channel LED3.

Then, when the rectified voltage continuously rises to reach the light emitting voltage V4, the LED channel LED4 of the lamp 10 may emit light. When the LED channel LED4 of the lamp 10 emits light, the switching circuit 34 of the current control circuit 14, connected to the LED channel LED4, may provide a current path. At this time, the LED channels LED1 to LED3 may also maintain the light emission state.

When the rectified voltage reaches the light emitting voltage V4 such that the LED channel LED4 emits light and the current path is formed through the switching circuit 34, the level of the current sensing voltage of the current sensing resistor Rs may rise. At this time, the current sensing voltage may have a higher level than the reference voltage VREF3. Therefore, the NMOS transistor 52 of the switching circuit 33 may be turned off by the output of the comparator 50. That is, the switching circuit 33 may be turned off, and the switching circuit 34 may provide a selective current path corresponding to the light emission of the LED channel LED2.

Then, although the rectified voltage continuously rises, the switching circuit 34 may maintain the turn-on state, because the reference voltage VREF4 provided to the switching circuit 34 has a higher level than the current sensing voltage formed in the current sensing resistor Rs by the upper limit level of the rectified voltage.

Figure 3:
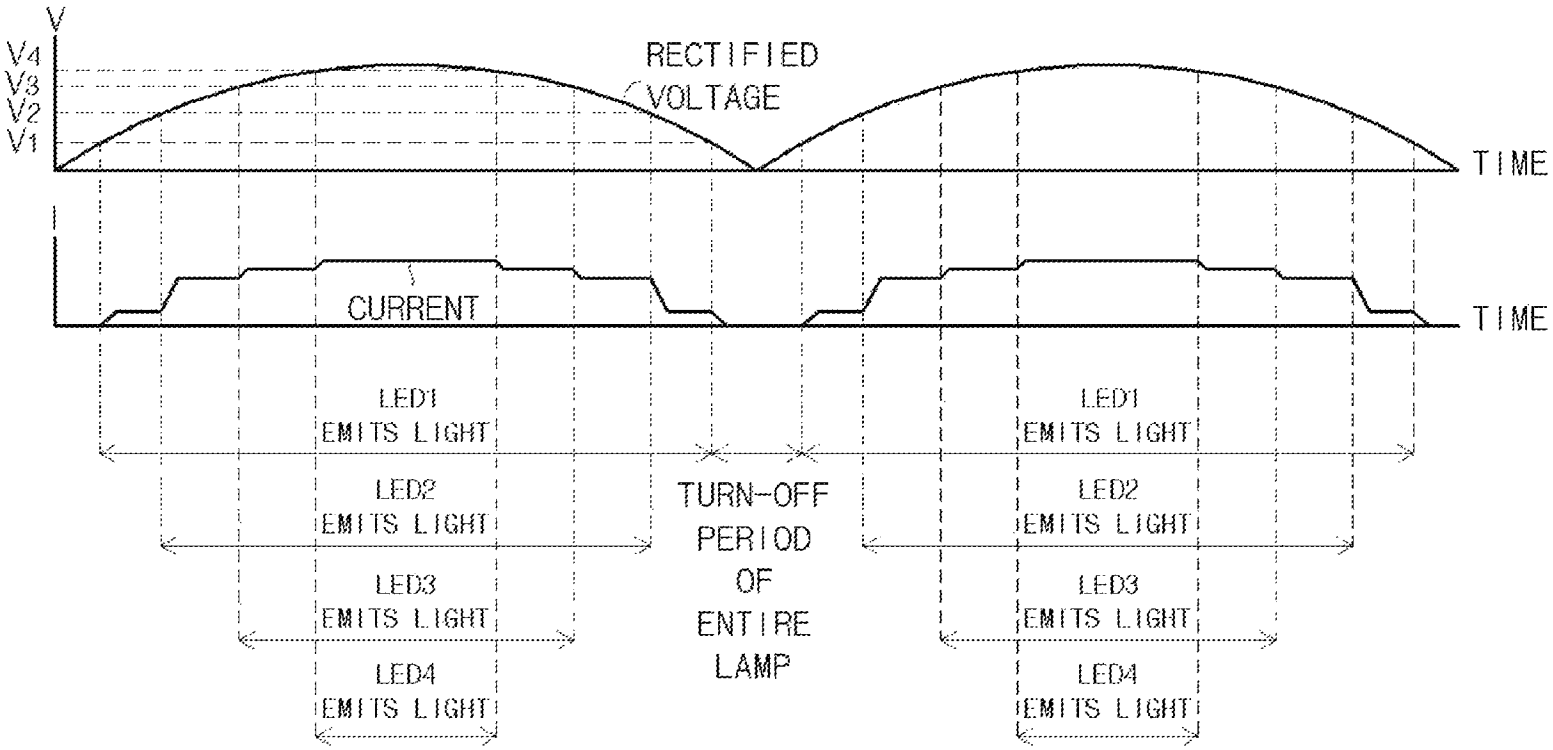
FIG. 3 is a waveform diagram for describing the occurrence of a flicker in a general LED lighting apparatus.

When the LED channels LED1 to LED4 sequentially emit light in response to the rises of the rectified voltage, the current corresponding to the light emission states may increase in a stepwise manner as illustrated in FIG. 3. That is, since the current control circuit 14 performs constant current regulation, the current corresponding to the light emission of each LED channel may retain a predetermined level. When the number of LED channels to emit light increases, the level of the current may rise in response to the increase in number of LED channels.

After rising to the upper limit level as described above, the rectified voltage may start to fall.

When the rectified voltage falls below the light emitting voltage V4, the LED channel LED4 of the lamp 10 may be turned off.

When the LED channel LED4 is turned off, the lamp 10 may maintain the light emission state through the LEDs LED3, LED2, and LED1. Thus, a current path may be formed by the switching circuit 33 connected to the LED channel LED3.

Then, when the rectified voltage sequentially falls below the light emitting voltage V3, the light emitting voltage V2, and the light emitting voltage V1, the LED channels LED3, LED2, and LED1 of the lamp 10 may be sequentially turned off.

As the LED channels LED3, LED2, and LED1 of the lamp 10 are sequentially turned off, the current control circuit 14 may shift and provide selective current paths formed by the switching circuits 33, 32, and 31. Furthermore, in response to the turn-off states of the LED channels LED1 to LED4, the level of the current may also decrease in a stepwise manner.

The control circuit of the general LED lighting apparatus may be operated in such a manner that a flicker occurrence period is formed, the flicker occurrence period at which the smallest amount of current is provided as illustrated in FIG. 3.

That is, when entering a valley period formed by the characteristic of the rectified voltage having a ripple, that is, the flicker occurrence period, the amount of current supplied to the LED channels LED1 to LED4 may be reduced to turn off the entire LED channels LED1 to LED4 of the lamp 10.

In the embodiment of the present invention, however, the valley period in which the ripple of the rectified voltage falls to the lowest point and then rises, that is, a period in which the entire lamp is turned off may be set to a control period. Then, as the control circuit performs valley-fill using the voltage of the charge and discharge module 60 during the control period, the lamp 10 may maintain the minimum light emission state.

That is, since the lamp 10 maintains the minimum light emission state in the valley period, the occurrence of flicker can be reduced.

Figure 4:
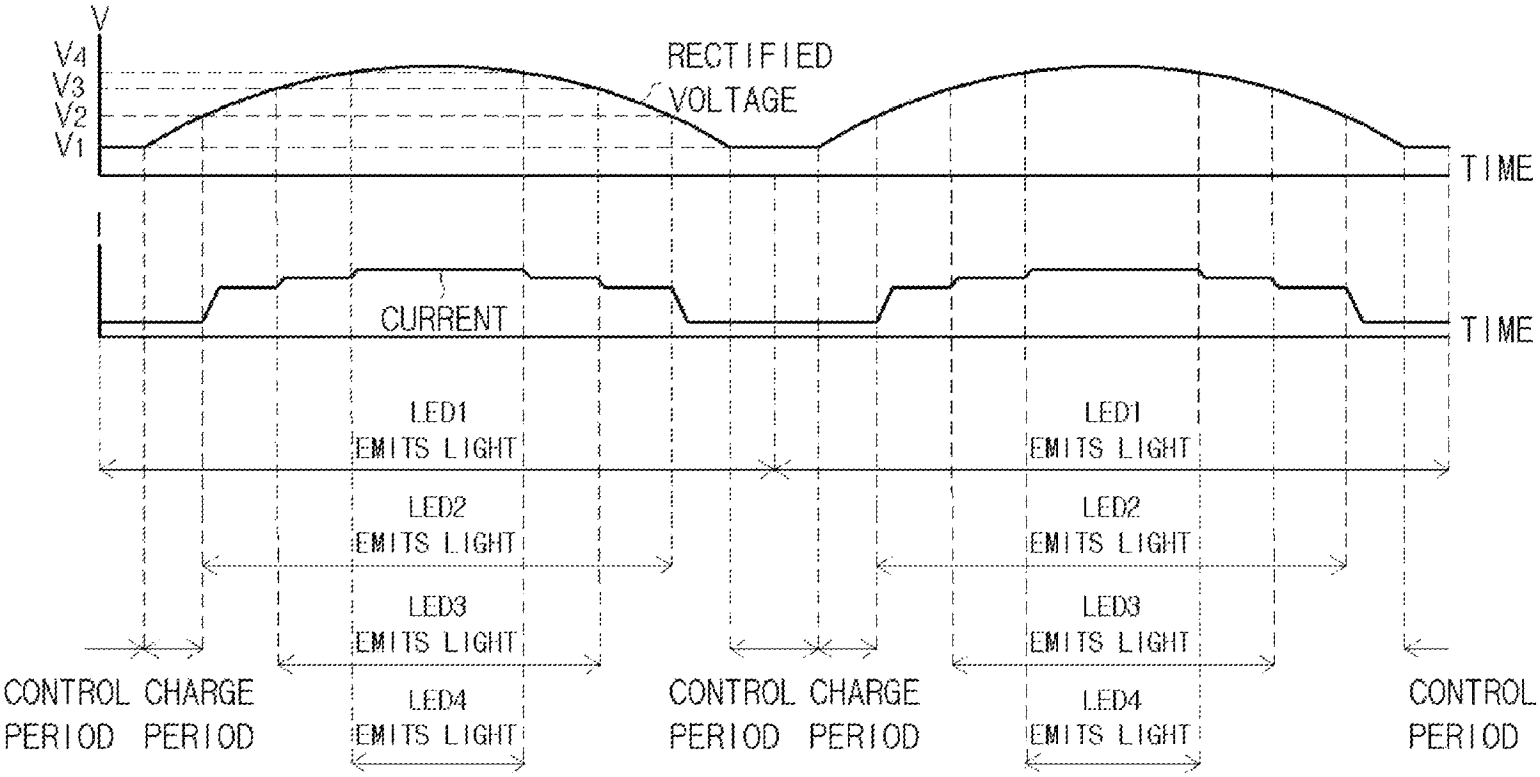
FIGS. 4 to 7 are waveform diagrams for describing the operation of the control circuit in accordance with the embodiment of FIG. 1.

For this operation, the embodiment of FIG. 1 may charge the charge and discharge module 60 until the LED channel LED2 emits light after the LED channel LED1 emits light as illustrated in FIG. 4, and discharge the voltage of the charge and discharge module 60 toward the LED channels LED1 to LED4 at the time point where the rectified voltage falls below the light emitting voltage V1, thereby maintaining the minimum light emission state.

At this time, the minimum light emission state may be set to a state in which the LED channel LED1 maintains light emission, as illustrated in FIG. 4.

In order to implement such a charge operation as illustrated in FIG. 4, the charge timing control unit 40 in the embedment of FIG. 1 may set the start and end points of the charge period by selecting one or more of a rectified voltage S1, a current S2 supplied to the LED channels LED1 to LED4, currents S3 to S6 of the current paths of the respective LED channels LED1 to LED4, and a current S7 of the current control circuit 14, that is, a current supplied to the current sensing resistor Rs, as a determination source Sa.

For example, while the current S3 flows through the current path of the LED channel LED1 in response to a rise of the rectified voltage, the charge timing control unit 40 may output a turn-on signal. At this time, suppose that the turn-on signal is outputted at a high level indicating an enable state.

When supposing that the voltage control unit 48 maintains a high-level output according to the determination that it does not correspond to the charging unsuitable state, the turn-on signal of the charge timing control unit 40 may be transmitted to the charge switch 44 through the AND gate AND. The charge switch 44 may be turned on by the turn-on signal of the charge timing control unit 40, and provide a rectified voltage to the charge and discharge module 60. The charge and discharge module 60 may be charged with the rectified voltage.

Then, when the rectified voltage rises to such a level that the LED channel LED2 emits light, no current path may be formed between the LED channel LED1 and the current control circuit 14. Thus, the charge timing control unit 40 may not output a turn-on signal, but the charge switch 44 may be turned off in connection with the operation of the charge timing control unit 40. That is, the charge of the charge and discharge module 60 may be stopped.

The charge timing control unit 40 may be configured in such a manner that the start point of the charge period is set to a time point at which the current S3 starts to flow between the LED channel LED1 and the terminal C1 of the current control circuit 14 in response to a rise of the rectified voltage, and the end point of the charge period is set to a time point at which the flow of the current S3 between the LED channel LED1 and the terminal C1 of the current control circuit 14 is ended in response to a rise of the rectified voltage.

The charge timing control unit 40 may be prevented from outputting a turn-on signal in response to the case in which the current S3 flows through the current path of the LED channel LED1 in response to a fall of the rectified voltage. That is, the output of the turn-on signal of the charge timing control unit 40 may be limited to a rise of the rectified voltage.

For this operation, the charge timing control unit 40 may switch to a charge state and output a turn-on signal only once, when the rectified voltage rises to reach the light emitting voltage V1. Then, while maintaining the charge state, the charge timing control unit 40 may switch to a state in which charging is not performed, when the rectified voltage falls below the light emitting voltage V1. Thus, the charge timing control unit 40 may output a turn-on signal in response to only a rise of the rectified voltage. This configuration can be easily embodied by those skilled in the art. Thus, the detailed descriptions thereof are omitted herein.

In order to describe the charge period in the embodiment of FIG. 4, the current S3 of the LED channel LED1 may be used, but the present invention is not limited thereto.

According to a designer's intention, the charge timing control unit 40 may be configured to detect the level of the rectified voltage S1, the amount of the current S2 supplied to the LED channels LED1 to LED4, and the amount of the current S7 in the current control circuit 14, such that charging is performed while the LED channel LED1 emits light in response to a rise of the rectified voltage.

In accordance with the embodiment of the present invention, the control period may be set to include a period in which a rectified voltage has a lower level than the light emitting voltage at which the LED channels maintain the minimum light emission state. In response to the control period, the charge period may be set to a period in which a rectified voltage has a higher level than the rectified voltage of the control period.

That is, the charge period may be set to include a period in which the rectified voltage has a level equal to or higher than the light emitting voltage at which the LED channels maintain the minimum light emission state, and set to a lower level than the maximum value of the rectified voltage.

In the embodiment of the present invention, as charging is performed at a lower voltage than the maximum voltage of the rectified voltage, the reduction of power consumption can be expected.

Figure 5:
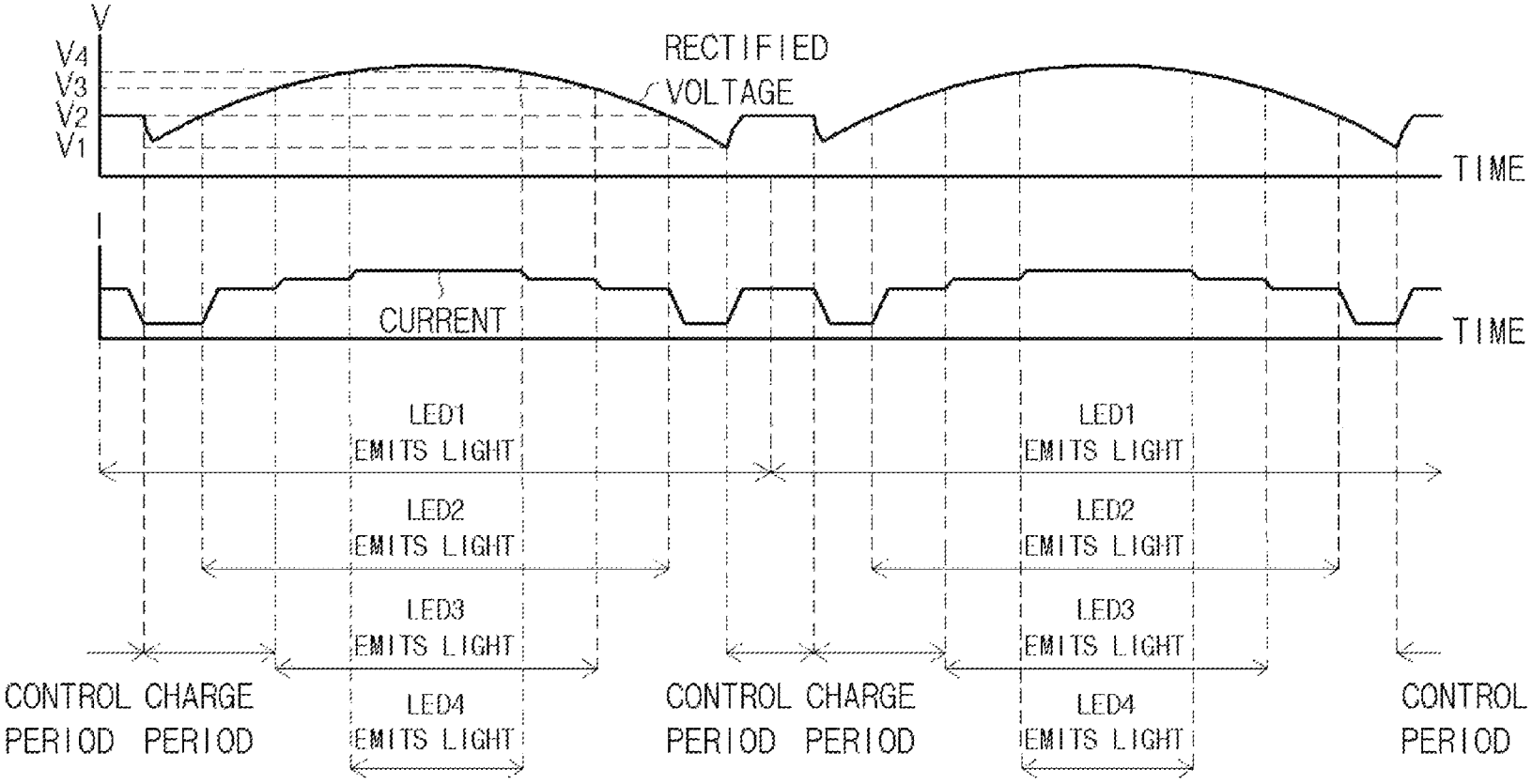

Furthermore, as illustrated in FIG. 5, the start point of the charge period may be set to a time point at which the LED channel LED1 emits light, that is, the rectified voltage rises over the light emitting voltage V1, and the end point of the charge period may be set to a time point at which the LED channel LED3 emits light, that is, the rectified voltage rises over the light emitting voltage V3.

When the charge period is set as illustrated in FIG. 5, the charging time of the charge and discharge module 60 can be sufficiently secured, and the charge and discharge module 60 can be charged at a higher level.

Figure 6:
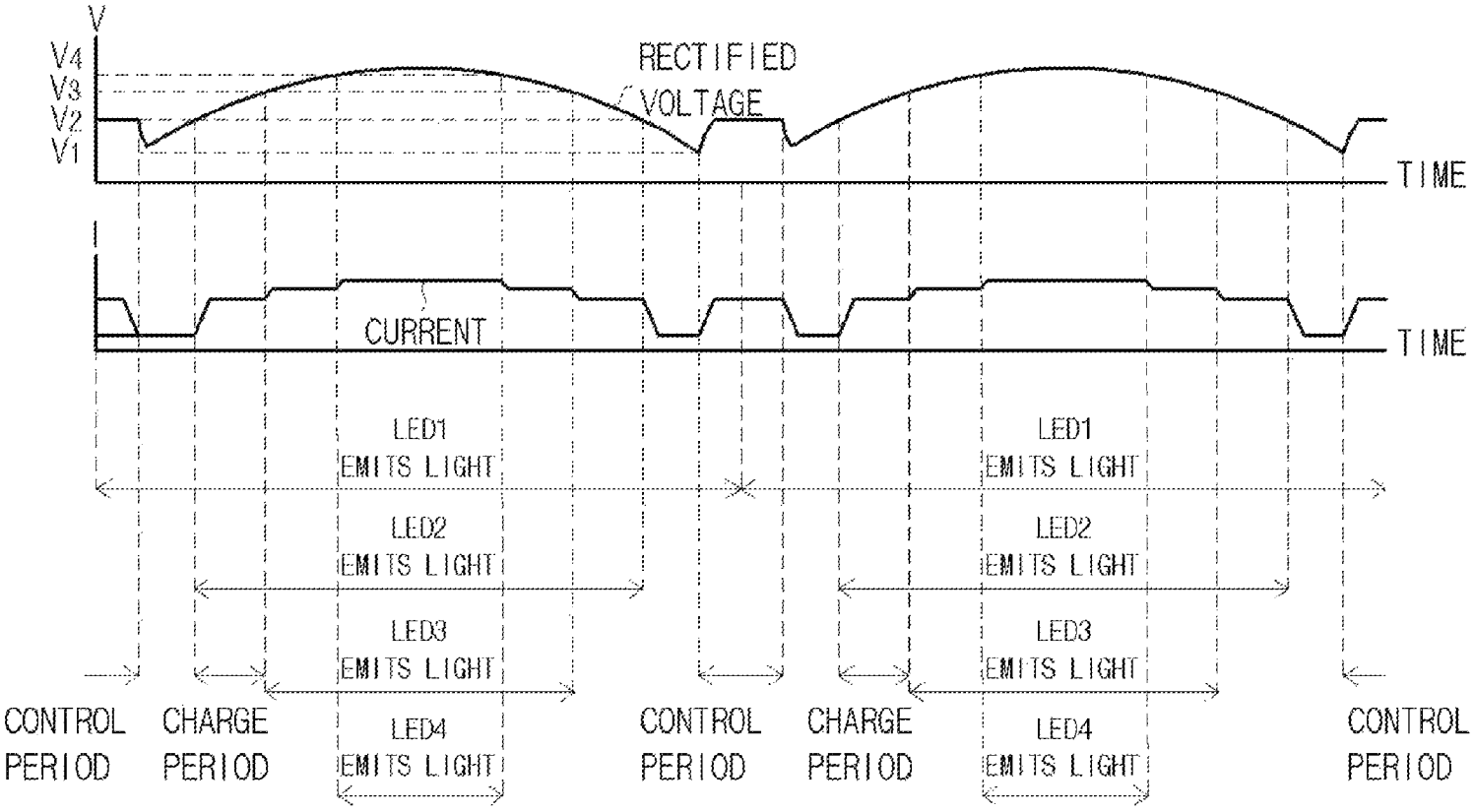

Furthermore, as illustrated in FIG. 6, the start point of the charge period may be set to a time point at which the LED channel LED2 emits light, that is, the rectified voltage rises over the light emitting voltage V2, and the end point of the charge period may be set to a time point at which the LED channel LED3 emits light, that is, the rectified voltage rises over the light emitting voltage V3.

When the charge period is set as illustrated in FIG. 6, the charge and discharge module 60 can be charged at a high level.

Figure 7:
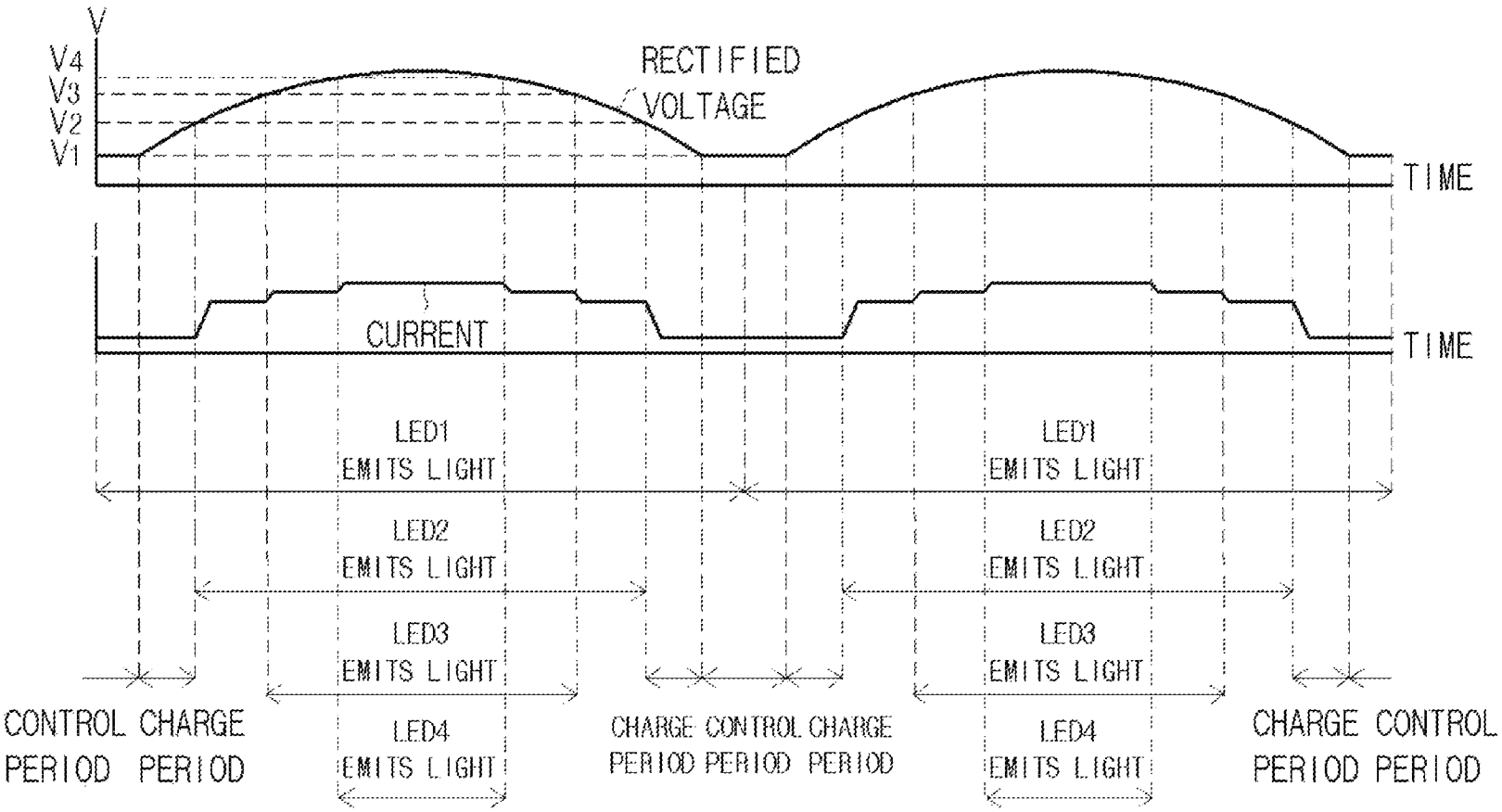

Furthermore, as illustrated in FIG. 7, charging can be performed at a period in which the rectified voltage rises and a period in which the rectified voltage falls.

For this operation, the charge timing control unit 40 may be configured to output a turn-on signal for charging, when a determination source selected from the rectified voltage S1, the current S2 supplied to the LED channels LED1 to LED4, the currents S3 to S6 of the current paths for the respective LED channels LED1 to LED4, and the current S7 of the current control circuit 14, that is, the current supplied to the current sensing resistor Rs enters a state which satisfies the charge period in response to a rise or fall of the rectified voltage.

When the discharge switch 46 is turned on by the discharge timing control unit 42 during the control period, the voltage stored in the charge and discharge module 60 may be supplied to the LED channels LED1 to LED4 as illustrated in FIGS. 4 to 7.

In order to implement such a discharge operation as illustrated in FIGS. 4 to 7, the discharge timing control unit 42 in the embedment of FIG. 1 may set the start and end points of the control period by selecting one or more of the rectified voltage S1, the current S2 supplied to the LED channels LED1 to LED4, the currents S3 to S6 of the current paths of the respective LED channels LED1 to LED4, and the current S7 of the current control circuit 14, that is, the current supplied to the current sensing resistor Rs, as a determination source Sb.

For example, when the amount of the current S2 supplied to the LED channels LED1 to LED4 drops below a predetermined level, that is, the amount of current supplied in response to the state in which only the LED channel LED1 emits light, the discharge timing control unit 42 may output a turn-on signal. At this time, suppose that the turn-on signal is outputted at a high level indicating an enable state.

When the turn-on signal of the discharge timing control unit 42 is transmitted to the discharge switch 46, the discharge switch 46 may be turned on to discharge the voltage stored in the capacitor C to the LED channels LED1 to LED4. In this case, a diode D may be added in order to distinguish between the rectified voltage and the voltage applied to the LED channels by the charge and discharge module 60.

When the voltage stored in the charge and discharge module 60 is supplied to the LED channels LED1 to LED4, the lamp 10 may maintain the minimum light emission state in which the LED channel LED1 emits light as illustrated in FIG. 4 or 7.

When the charge and discharge module 60 is charged with a voltage equal to or more than the light emitting voltage V2 as illustrated in FIGS. 5 and 6, the lamp 10 may maintain the minimum light emission state in which the LED channels LED1 and LED2 emit light as illustrated in FIGS. 5 and 6.

As the voltage control unit 48 is connected to the charge and discharge module 60, the voltage control unit 48 may determine the first state in which the voltage of the charge and discharge module 60 is equal to or more than the predetermined charge level.

Figure 8:
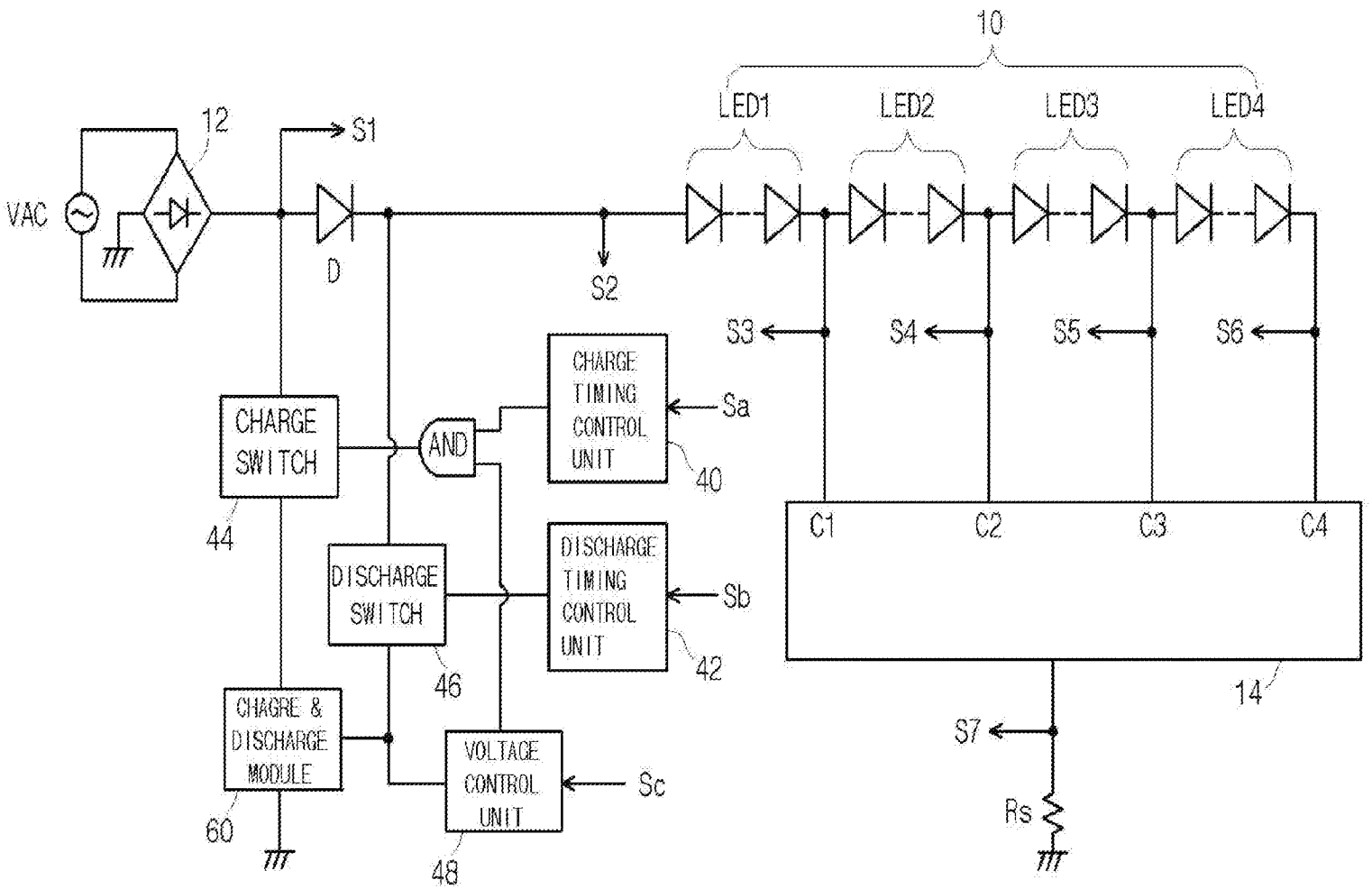
FIG. 8 is a circuit diagram illustrating another embodiment of the present invention.

Furthermore, in order to determine the second state in which the voltage of the charge and discharge module 60 is equal to or more than the rectified voltage and the third state in which the rectified voltage is equal to or less than the predetermined level, the voltage control unit 48 may be configured to receive the rectified voltage S1 or the current S2 supplied to the LED channels LED1 to LED4 as a determination source Sc, as illustrated in FIG. 8.

The voltage control unit 48 may determine the second state by comparing the rectified voltage S1 or the current S2 supplied to the LED channels LED1 to LED4 to the voltage of the charge and discharge module 60, and determine the third state by comparing an internal reference voltage having a constant level to the level of the rectified voltage S1.

Figure 9:
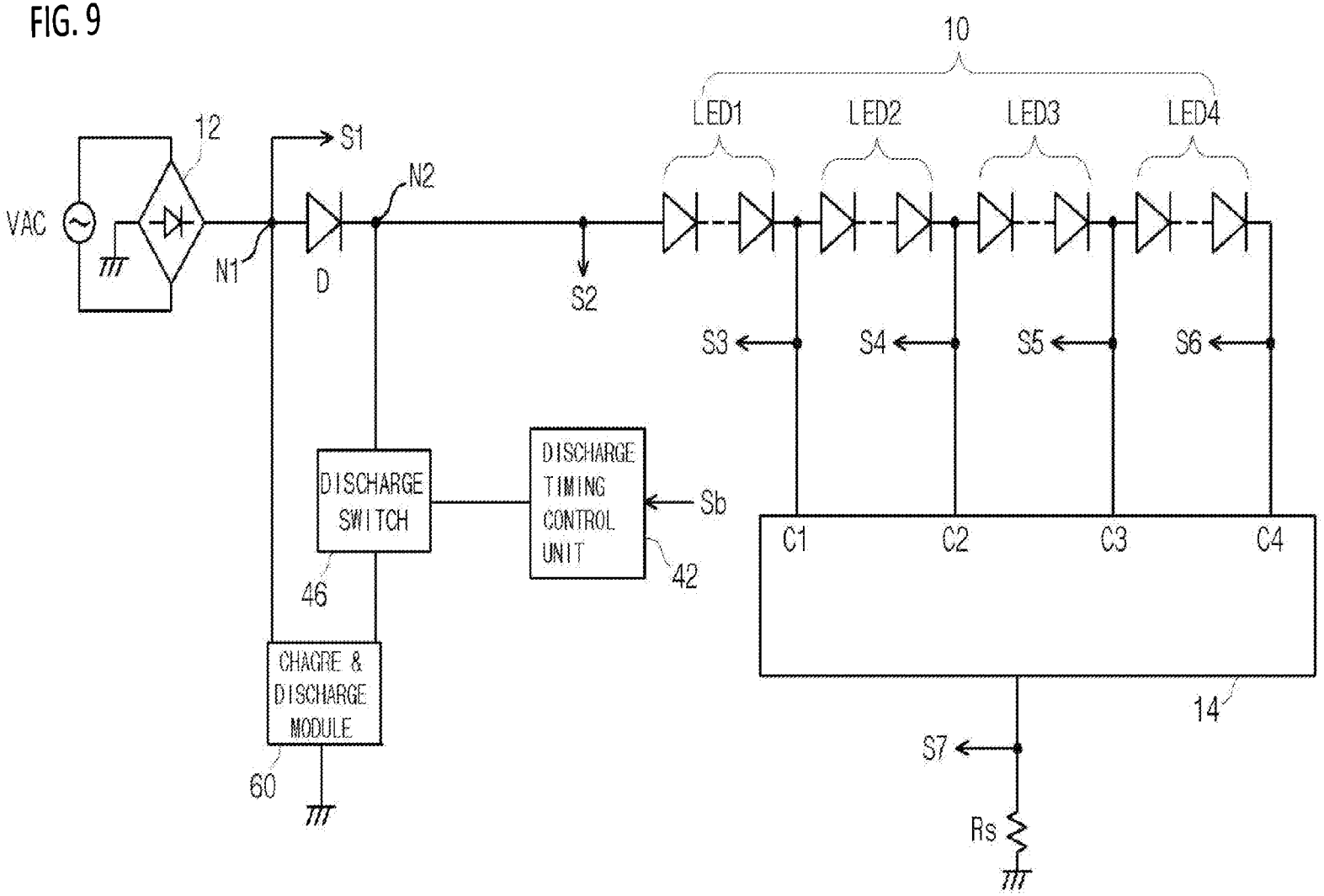
FIG. 9 is a circuit diagram illustrating another embodiment of the present invention.

FIG. 9 illustrates another embodiment of the present invention. The embodiment of FIG. 9 may include a discharge timing control unit 42, a discharge switch 46, and a charge and discharge module 60 as a flicker reduction circuit. In the embodiment of FIG. 9, the same parts as those of FIG. 1 are represented by like reference numerals, and the duplicated descriptions thereof are omitted herein.

The discharge timing control unit 42 may set the start and end points of a control period by selecting one or more of the rectified voltage S1, the current S2 supplied to the LED channels LED1 to LED4, the currents S3 to S6 of the current paths of the respective LED channels LED1 to LED4, and the current S7 of the current control circuit 14, that is, the current supplied to the current sensing resistor Rs, as a determination source Sb.

Figure 10:
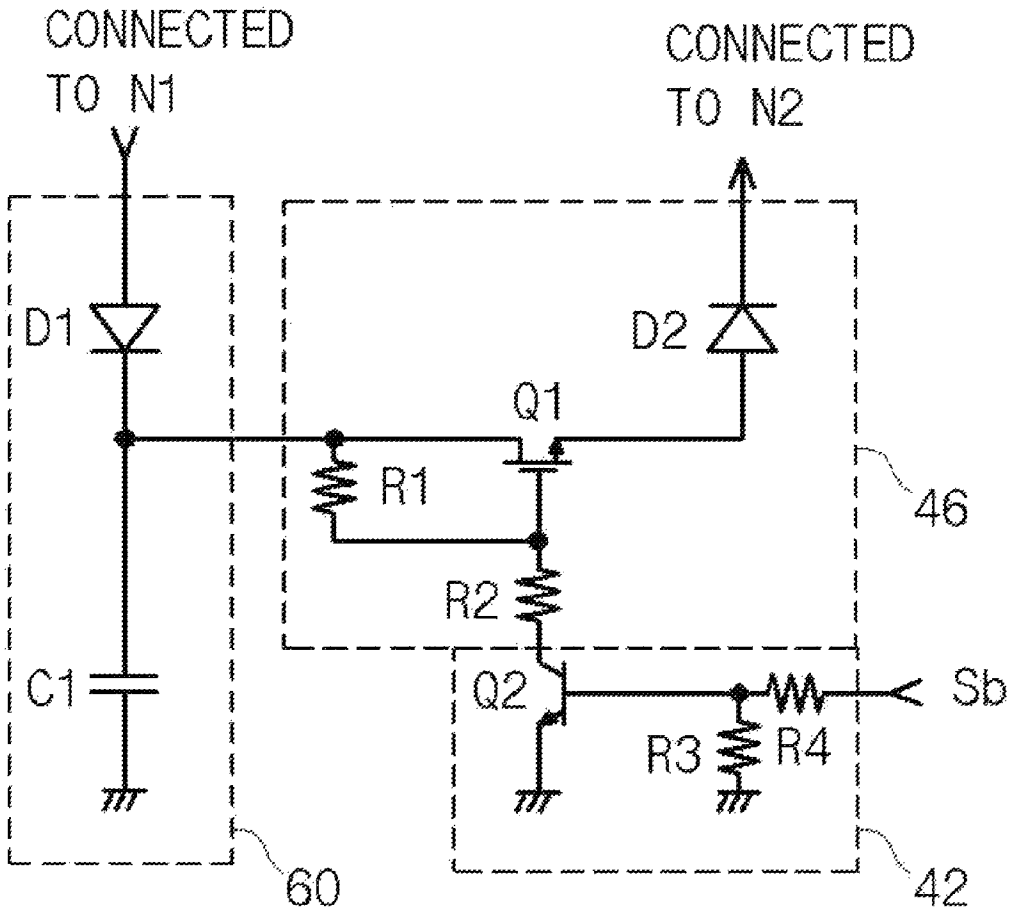
FIG. 10 is a detailed circuit diagram illustrating an example of a charge and discharge module, a discharge switch, and a discharge timing control unit of FIG. 9.
Figure 11:
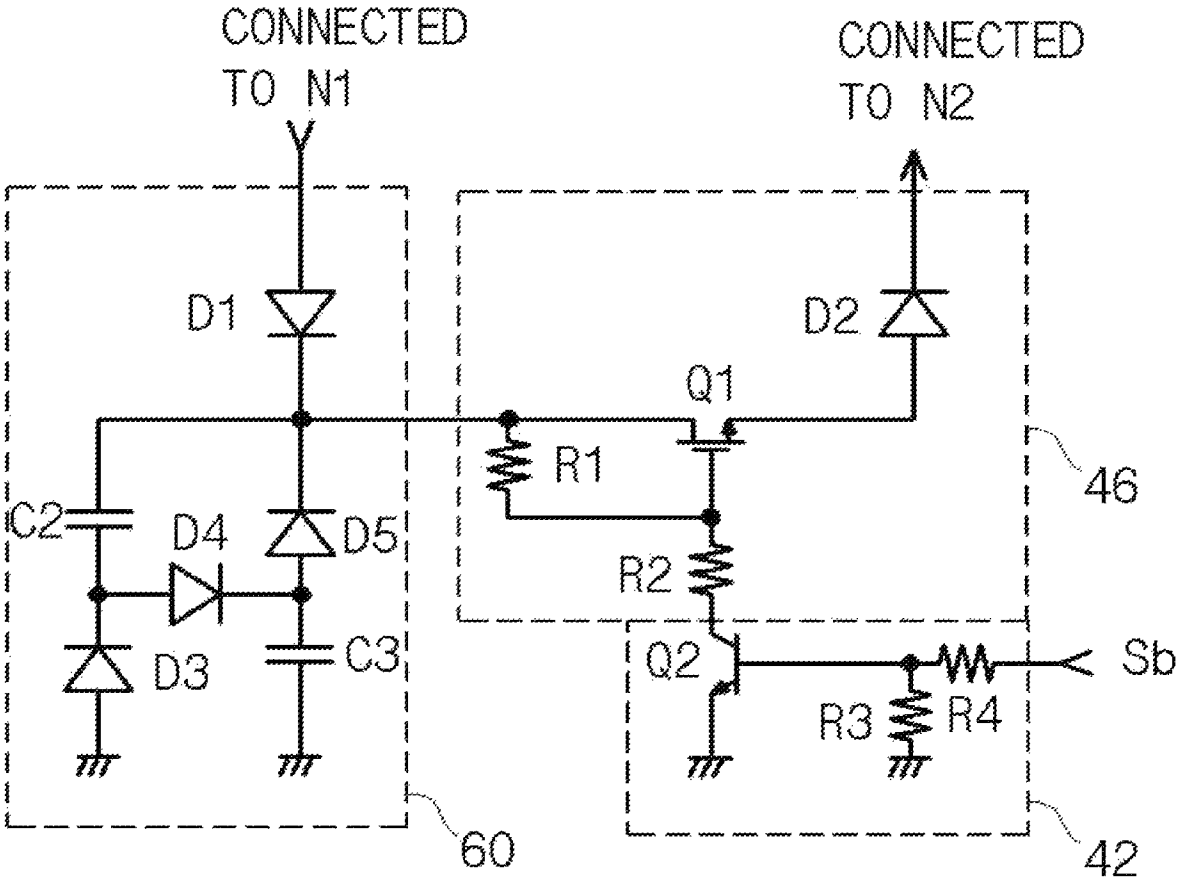
FIG. 11 is a detailed circuit diagram illustrating another example of a charge and discharge module, a discharge switch, and a discharge timing control unit of FIG. 9.

The charge and discharge module 60 may include a capacitor C as illustrated in FIG. 10 or include a valley fill circuit as illustrated in FIG. 11.

The charge and discharge module 60 may be charged with a rectified voltage of a node N1, which is equal to S1. When the discharge switch 46 is turned on, the charge and discharge module 60 may supply a voltage toward the LED channels LED1 to LED4 through a node N2.

The discharge switch 46 may be turned on/off according to control of the discharge timing control unit 42.

That is, the discharge timing control unit 42 may control the discharge switch 46 to be turned on at the control period, based on the determination source Sb. When the discharge switch 46 is turned on, the voltage of the charge and discharge module 60 may be supplied toward the LED channels LED1 to LED4 through the node N2.

The charge and discharge module 60, the discharge switch 46, and the discharge timing control unit 42 of FIG. 9 may be embodied as illustrated in FIG. 10.

The charge and discharge module 60 may include a capacitor C1 and a diode D1. The diode D1 may be configured to transmit the rectified voltage of the node N1 in one direction of the capacitor C1, and the capacitor C1 be configured as an example of a charge and discharge element.

The discharge timing control unit 42 may include resistors R3 and R4 and a transistor Q2. The transistor Q2 may include an NPN-type bipolar transistor. The resistors R3 and R4 connected in parallel to each other may be configured to divide the determination source Sb and transmit the divided voltage to the base of the transistor Q2, and the transistor Q2 may be configured to vary the state of the voltage applied to the resistor R2 according to the voltage state of the base.

The discharge switch 46 may include resistors R1 and R2, a transistor Q1, and a diode D2. The transistor Q1 may include an NMOS transistor. The resistor R1 may be configured between the gate and source of the transistor Q1, and the resistor R2 may be configured between the gate of the transistor Q1 and the collector of the transistor Q2. The source of the transistor Q1 may be connected to the capacitor C1, and the drain of the transistor Q1 may be connected to the node N2 through the diode D2.

Figure 12:
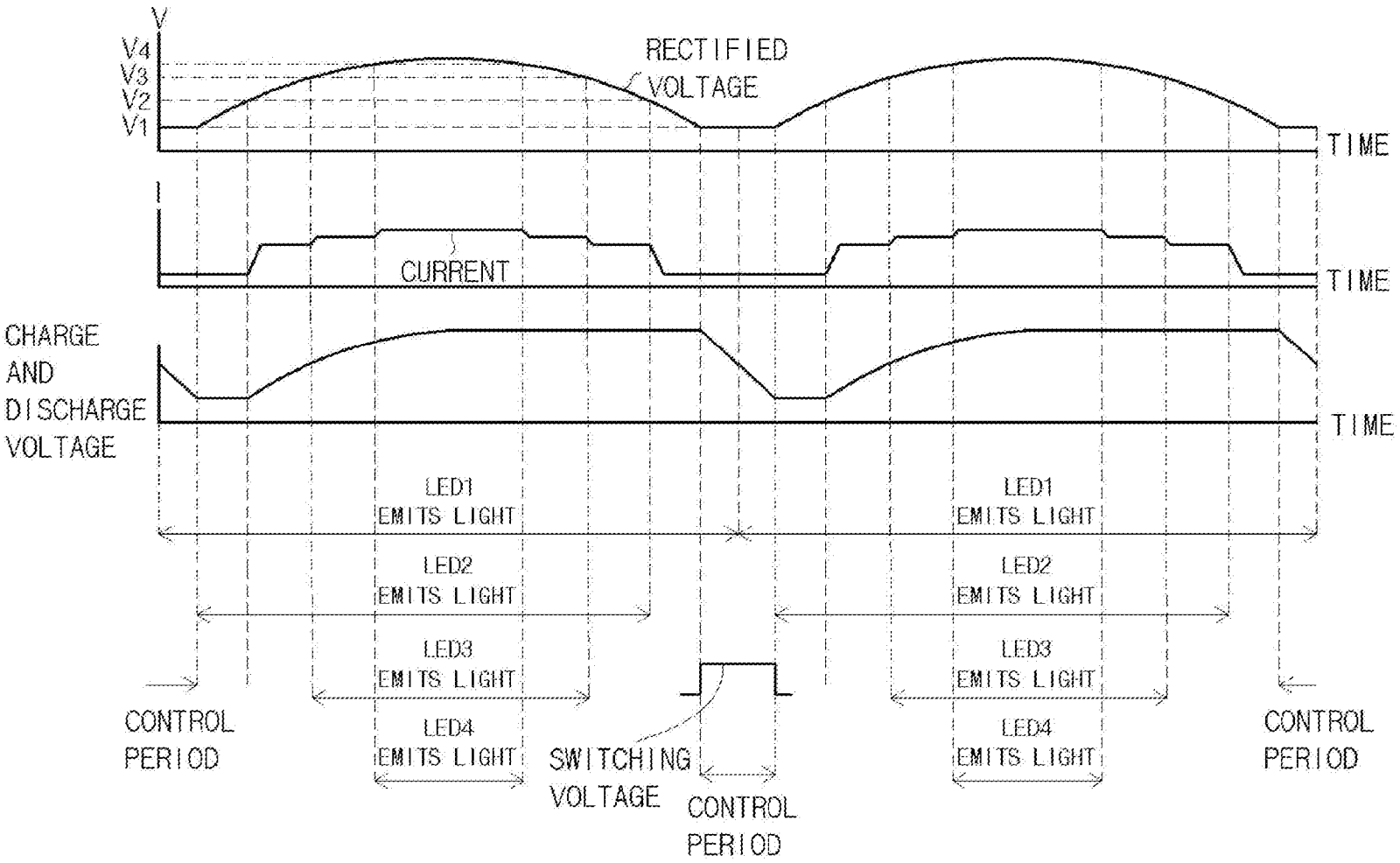
FIG. 12 is a waveform diagram for describing the operation of the control circuit in accordance with the embodiment of FIG. 9.

The operation of the embodiment of FIGS. 9 and 10 will be described with reference to FIG. 12. FIG. 12 illustrates that a valley period in which a rectified voltage falls below the light emitting voltage V1 of the LED channel LED1 is set to the control period. During the control period, the determination source Sb may be activated.

According to the configuration of the embodiment illustrated in FIGS. 9 and 10, the determination source Sb may not be activated in response to the period in which the rectified voltage rises/falls while retaining the light emitting voltage V1 or more.

When the determination source Sb is not activated, the transistor Q2 of the discharge timing control unit 42 may maintain a turn-off state, and the transistor Q1 of the discharge switch 46 may also maintain a turn-off state in connection with the state of the discharge timing control unit 42.

When the determination source Sb is not activated, the rectified voltage may be supplied to the capacitor C1 through the diode D1. At this time, the rectified voltage may maintain a level which rises/falls while retaining the light emitting voltage V1 or more. Thus, the capacitor C1 may be charged in response to a rise of the rectified voltage as illustrated in FIG. 12. When the rectified voltage falls, the capacitor C1 may maintain the charged state.

Then, when the rectified voltage falls below the light emitting voltage V1, the determination source Sb may be activated. When the determination source Sb is activated, the transistor Q2 of the discharge timing control unit 42 may be turned on, and a switching voltage between the collector and emitter may transition to a high level. As the transistor Q2 is turned on, the transistor Q1 of the discharge switch 46 may also be turned on by a high-level voltage applied to the gate thereof.

That is, the determination source Sb may be activated to form a current path including the transistor Q1 and the diode D2. Therefore, the voltage stored in the capacitor C1 may be applied to the node N2 through the current path formed in the discharge switch 46. As a result, the voltage stored in the capacitor C1 may be supplied toward the LED channels LED1 to LED4 through the node N2.

Thus, the capacitor C1 may be discharged during the control period, and luminance equal to or more than the minimum light emission state may be maintained, which makes it possible to reduce the occurrence of a flicker.

In the embodiment of FIG. 9, the charge and discharge module 60 may include a valley-fill circuit as illustrated in FIG. 11. In FIG. 11, the discharge timing control unit 42 and the discharge switch 46 may have the same configuration as illustrated in FIG. 10. Thus, the duplication descriptions thereof are omitted herein.

In the charge and discharge module 60 of FIG. 11, the capacitors C2 and C3 and the diodes D3 to D5 may correspond to the valley-fill circuit.

Between the capacitor C2 and the capacitor C3, the diode D4 may be connected in the forward direction. Between the diode D1 and the capacitor C3, the diode D4 may be connected in the reverse direction. The capacitor C2 and the diode D5 may be connected in parallel to the diode D1. The diode D4 may be connected between the grounded diode D3 and the capacitor C3. Between the capacitor C2 and the ground, the diode D3 may be connected in the reverse direction.

As the valley-fill circuit is configured in the charge and discharge module 60, the charge and discharge module 60 may be configured in such a manner that the capacitors C2 and C3 are equivalently connected in series to each other in response to charge, and the capacitors C2 and C3 are equivalently connected in parallel to each other in response to discharge.

As the determination source Sb is deactivated, the discharge switch 46 may maintain a turn-off state. Thus, the charge and discharge module 60 may be charged with a rectified voltage supplied through the diode D1.

Furthermore, as the determination source Sb is activated, the discharge switch 46 may be turned on. Thus, the charge and discharge module 60 may provide the stored voltage to the node N2 through the current path formed in the discharge switch 46. As a result, the voltage stored in the charge and discharge module 60 may be supplied to the LED channels LED1 to LED4 through the node N2.

Thus, during the control period, the capacitors C2 and C3 may be discharged, and luminance equal to or more than the minimum light emission state may be maintained, which makes it possible to reduce the occurrence of flicker.

In the embodiment of the present invention, the current control circuit 14 may include transistors 50 serving as switching elements in the respective switching circuits 31 to 34 for forming a current path.

Figure 13:
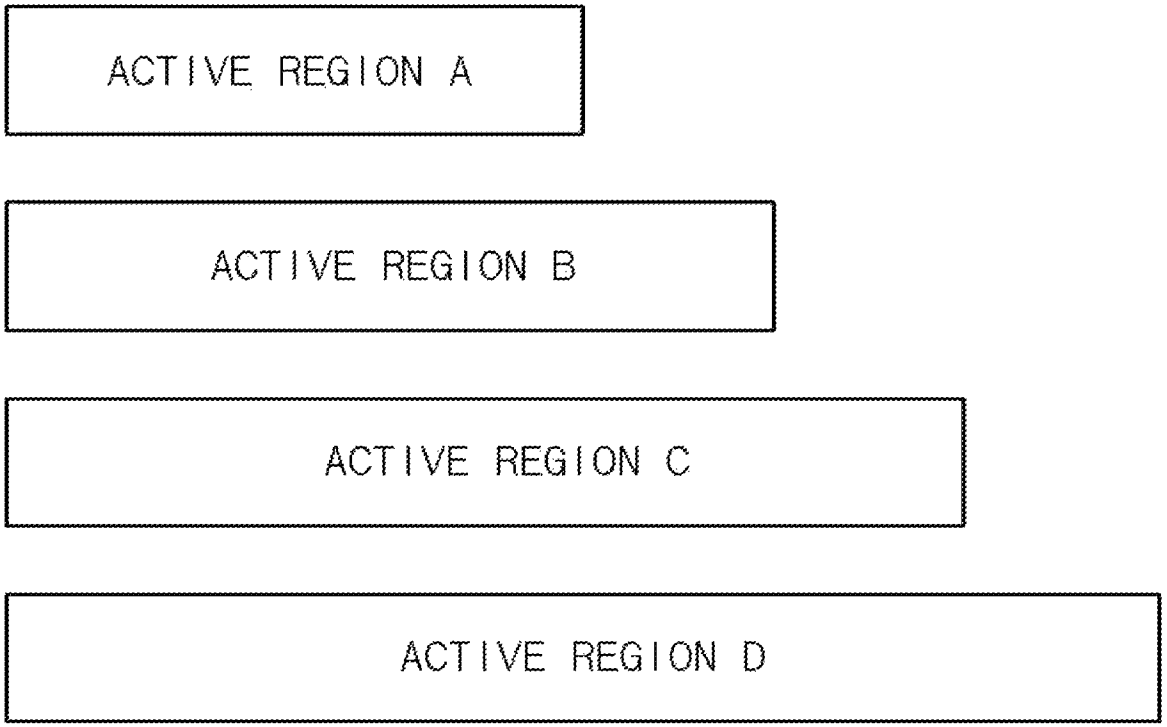
FIG. 13 is a layout diagram illustrating active regions of transistors provided in a current control circuit.

Each of the transistors 52 may form an active region having a different size in response to a current amount, as illustrated in FIG. 13.

That is, each of the transistors 52 providing a current path in the current control circuit 14 may have a resistance value which is adjusted in response to current consumption.

Therefore, the transistor 52 through which a large amount of current flows may be designed to have a low resistance value as a large active region is formed. As a result, a heat generation problem of the current control circuit 14 may be improved.

As the embodiment of the present invention is configured, the LED lighting apparatus which is driven by the rectified voltage may maintain luminance equal to or more than the minimum light emission state without a period in which the entire lamp is turned off, thereby reducing the occurrence of a flicker.

In accordance with the embodiments of the present invention, a capacitor with a small capacity may be used to sufficiently reduce a flicker caused by voltage charge and discharge. Thus, although the capacitors are applied, the reduction of lifetime or power factor can be minimized, and the occurrence of flicker can also be reduced.

Furthermore, since the charging operation for reducing a flicker is performed at a lower level than the peak value (maximum value) of the rectified voltage, an unnecessary charging operation using an excessive voltage can be prevented to minimize power consumption.

Therefore, the reliability of the LED lighting apparatus can be improved.

While various embodiments have been described above, it will be understood to those skilled in the art that the embodiments described are by way of example only. Accordingly, the disclosure described herein should not be limited based on the described embodiments.

What is claimed is:

1. A control circuit of an LED lighting apparatus divided into a plurality of LED channels, comprising:

a current control circuit configured to provide a current path corresponding to sequential emissions of the LED channels in response to a rectified voltage; and a flicker reduction circuit comprising a charge and discharge module charged by the rectified voltage and discharging the LED channels, and configured to control one or more of charge timing, a charged voltage, and discharge timing of the charge and discharge module such that the charge and discharge module supplies a voltage to the LED channels at least during a control period at which the amount of current supplied to the LED channels is the smallest.

2. The control circuit of claim 1, wherein the charge and discharge module comprises any one of a capacitor and a valley fill circuit.

3. The control circuit of claim 1, wherein the flicker reduction circuit controls one or more of the charge timing, the charged voltage, and the discharge timing, using one or more of the rectified voltage, the current supplied to the LED channels, a current of the current path for each LED channel, and a sensing current of the current control circuit as a common determination source or each determination source.

4. The control circuit of claim 1, wherein the flicker reduction circuit supplies the voltage in response to the control period including a period in which the rectified voltage becomes lower than a level of a minimum light emission state of the LED channels.

5. The control circuit of claim 1, wherein the flicker reduction circuit comprises one or more of:

a charge control circuit configured to supply the rectified voltage to the charge and discharge module during a predetermined charge period; and a discharge control circuit configured to supply the voltage of the charge and discharge module to the LED channels during the control period.

6. The control circuit of claim 5, wherein the charge period is set to include a period having a level equal to or higher than a light emitting voltage at which the LED channels maintain the minimum light emission state.

7. The control circuit of claim 6, wherein the charge period is set to have a lower level than the light emitting voltage at which the LED channels maintain a maximum light emission state.

8. The control circuit of claim 5, wherein the charge period is set in one or more of a region in which the rectified voltage rises and a region in which the rectified voltage falls.

9. The control circuit of claim 5, wherein the charge control circuit comprises:

a charge switch configured to switch supplying the rectified voltage to the charge and discharge module; and a charge timing control unit configured to turn on the charge switch during the charge period.

10. The control circuit of claim 5, wherein the discharge control circuit comprises:

a discharge switch configured to switch supplying the voltage of the charge and discharge module to the plurality of LED channels; and a discharge timing control unit configured to turn on the discharge switch during the control period.

11. The control circuit of claim 5, wherein the discharge control circuit supplies the voltage of the charge and discharge module to an input terminal of any one of the LED channels.

12. The control circuit of claim 1, wherein the flicker reduction circuit comprises a voltage control unit configured to provide a voltage control signal indicating a charging unsuitable state, the charging unsuitable state including one or more of a first state in which the voltage of the charge and discharge module is equal to or more than a predetermined charge level, a second state in which the voltage of the charge and discharge module is equal to or more than the rectified voltage level, and a third state in which the rectified voltage is equal to or less than a predetermined level, and stops the charging operation using the rectified voltage in response to the charging unsuitable state.

13. The control circuit of claim 12, wherein the flicker reduction circuit comprises:

a charge control circuit configured to provide the rectified voltage to the charge and discharge module during a predetermined charge period which does not correspond to the charging unsuitable state; and a discharge control circuit configured to supply the voltage of the charge and discharge module to the LED channels during the control period.

14. The control circuit of claim 13, wherein the charge control circuit comprises:

a charge switch configured to switch supplying the rectified voltage to the charge and discharge module;

a charge timing control unit configured to provide a turn-on signal for turning on the charge switch during the charge period; and a switching control circuit configured to turn on the charge switch during a time which does not correspond to the charging unsuitable state but satisfies the charge period, according to the voltage control signal and the turn-on signal.

15. The control circuit of claim 1, wherein the current control circuit comprises switching elements for forming a current path at the respective LED channels, and an active region of each of the switching elements is formed at a different size in response to the current amount, and has a resistance value adjusted in response to current consumption.

16. A control circuit of an LED lighting apparatus divided into a plurality of LED channels, comprising a charge and discharge module charged by a rectified voltage provided to the plurality of LED channels and discharging the LED channels, wherein the control circuit controls one or more of charge timing, a charged voltage, and discharge timing of the charge and discharge module such that the charge and discharge module supplies a voltage to the LED channels at least during a control period at which the amount of current supplied to the LED channels is the smallest.

17. The control circuit of claim 16, wherein the charge and discharge module comprises any one of a capacitor and a valley fill circuit.

18. The control circuit of claim 16, wherein the control circuit controls one or more of the charge timing, the charged voltage, and the discharge timing, using one or more of the rectified voltage, the current supplied to the LED channels, a current of the current path for each of the LED channels, and a sensing current of a current control circuit for providing the current path to the LED channels, as a common determination source or each determination source.

19. The control circuit of claim 16, further comprising one or more of:

a charge control circuit configured to supply the rectified voltage to the charge and discharge module during a predetermined charge period; and a discharge control circuit configured to supply the voltage of the charge and discharge module to the LED channels during the control period.

20. The control circuit of claim 19, further comprising a voltage control unit configured to provide a voltage control signal indicating a charging unsuitable state, the charging unsuitable state including one or more of a first state in which the voltage of the charge and discharge module is equal to or more than a predetermined charge level, a second state in which the voltage of the charge and discharge module is equal to or more than the rectified voltage level, and a third state in which the rectified voltage is equal to or less than a predetermined level, wherein the control circuit stops the charging operation using the rectified voltage in response to the charging unsuitable state.

21. The control circuit of claim 20, wherein the charge control circuit comprises:

a charge switch configured to switch supplying the rectified voltage to the charge and discharge module;

a charge timing control unit configured to provide a turn-on signal for turning on the charge switch during the charge period; and a switching control circuit configured to turn on the charge switch during a time which does not correspond to the charging unsuitable state but satisfies the charge period, according to the voltage control signal and the turn-on signal, wherein the charge control circuit provides the rectified voltage to the charge and discharge module during a predetermined charge period which does not correspond to the charging unsuitable state.

* * * * *